US006385811B1

(12) United States Patent
Dilger et al.

(10) Patent No.: US 6,385,811 B1
(45) Date of Patent: May 14, 2002

(54) SUCTION HEAD FOR FLOOR VACUUM CLEANERS

(75) Inventors: Horst Dilger, Morsbach; Dieter Kaffenberger, Wiehl; Thomas Lind, Freudenberg; Hans-Joachim Steudtner, Reichshof, all of (DE)

(73) Assignee: Wessel-Werk GmbH, Reichshof-Wildbergerhütte (DE)

( * ) Notice: Subject to any disclaimer, the term of this patent is extended or adjusted under 35 U.S.C. 154(b) by 0 days.

(21) Appl. No.: 09/703,489

(22) Filed: Nov. 2, 2000

(30) Foreign Application Priority Data

Sep. 2, 2000 (EP) ..... 00119069

(51) Int. Cl.[7] ..... A47L 9/06
(52) U.S. Cl. ..... 15/373; 15/398; 15/359
(58) Field of Search ..... 15/368, 373, 398, 15/415.1, 354, 359, 355, 393

(56) References Cited

U.S. PATENT DOCUMENTS 3,727,263 A * 4/1973 Johansson ..... 15/373
3,821,831 A * 7/1974 Grover ..... 15/339
3,952,363 A * 4/1976 Lindman ..... 15/373
4,073,031 A * 2/1978 Schwartz ..... 15/373
4,180,887 A * 1/1980 Wudel et al. ..... 15/359

FOREIGN PATENT DOCUMENTS

DE 196 08 188 9/1997
DE 197 17 291 10/1998

* cited by examiner

*Primary Examiner*—Elizabeth McKane
*Assistant Examiner*—Theresa T. Snider
(74) *Attorney, Agent, or Firm*—Collard & Roe, P.C.

(57) ABSTRACT

A suction head for floor vacuum cleaners has a unitary plastic housing (1) containing a suction channel (2), and a bottom plate (7) arranged on the underside of the housing and having a suction mouth (13). The suction mouth adjoins a vertically aligned, box-shaped connection element (14) of the suction channel and feeds into a bottom channel (15) of the bottom plate (7). The bottom plate (7) is pivot-mounted both on the connection element (14) of the suction channel and also at the end side on the inner surfaces of the plastic housing (1). For this purpose, the box-shaped connection element (14) contains transverse bridges (17) that define the suction channel laterally and which have bottom edges designed as bearing surfaces (18) rounded in a curved manner. The bottom plate (7) is supported on the curved, rounded support surfaces (18) of the connection element (14), and rotatably interlocked with the wall surfaces of the connection element (14) extending parallel with the transverse bridges.

9 Claims, 5 Drawing Sheets

SUCTION HEAD FOR FLOOR VACUUM CLEANERS

BACKGROUND OF THE INVENTION

1. Field of the Invention

The invention relates to a suction head for floor vacuum cleaners comprising a one-part plastic housing containing a suction channel and a top side opening for a foot switch. A bristles carrier plate is vertically movably arranged in the plastic housing and can be lowered against the action of pressure springs by actuating a foot switch inserted in the opening. A bottom plate arranged on the underside of the housing has a suction mouth adjoining a vertically aligned, box-shaped connection element of the suction channel. The suction mouth feeds into a bottom channel of the bottom plate. The plastic housing has two vertically aligned, dimensionally stable screw domes for guiding the bristles carrier plate, as well as the pressure springs. Strips of bristles and/or rubber lips are connected with the underside of the bristles carrier plate. The bristles and the lips can be retracted and extended on the underside of the plastic housing by lifting and lowering the bristles carrier plate.

2. The Prior Art

With the designs known in practical life, on which the invention is based, a bottom plate is screwed to screw domes and in this manner rigidly connected with a plastic housing.

In addition, suction heads are known with different constructional designs. For better adaptation to the floor covering, the suction heads have a movable bottom plate. With the design known from DE-A 197 17 291, the casing of the suction head has a plurality of screw domes aligned in one line, the suction domes being designed flexible, for example by means of a sheet material hinge. The bottom plate is secured on the flexible screw domes and is capable of performing swivel movements limited by stop elements. For the resetting movement, pressure springs are provided, which are preferably plugged onto and guided on the flexible screw domes. This construction requires a relatively large expenditure in time and expense to manufacture and assemble. Furthermore, the flexible screw domes are sensitive.

A suction head for a floor vacuum cleaner known from DE-A 196 08 188 has a flexibly supported bottom plate. The bottom plate is capable of performing horizontal and vertical movements that are limited by stop means. The required resetting forces are expended by pressure springs. Costly and complicated automatic assembly equipment is required for producing such suction heads in a series production with high numbers of units. Furthermore, the known design provides no possibility for extending strips of bristles on the underside for vacuum-cleaning smooth floors.

Suction heads for floor vacuum cleaners, which are referred to in practical life also as vacuum cleaner nozzles, are mass-produced articles. The invention addresses the problem of providing a suction nozzle with the structure described above that is simple in construction and has a movable bottom plate adapting itself to the floor. The goal is to keep the number of components to be assembled as small as possible. In addition, the goal is to make it possible to selectively equip the suction head also with a rigid bottom plate with no change in the design of the plastic housing.

SUMMARY OF THE INVENTION

This problem in the above-described suction heads is solved according to the invention by pivotally mounting the bottom plate both on the connection element of the suction channel and at the end side on the inner surfaces of the plastic housing. The device has a box-shaped connection element with transverse bridges that limit the suction channel laterally and whose lower edges are designed in the form of support surfaces that are rounded in the form of a curve. In addition the bottom plate is supported on the rounded, curved support surfaces of the connection element. The bottom plate is also rotatably interlocked with wall surfaces of the connection element extending parallel with the transverse bridges.

The wall surfaces of the connection element preferably contain bores that are engaged by pins shaped by molding on the bottom plate. The support surfaces rounded in the form of curves may have a side collar for fixing the bottom plate axially. The arrangement of the bottom plate on the plastic housing as defined by the invention requires no additional assembly material. The plastic housing and the bottom plate are single-piece, molded plastic components that have all the elements required for movably holding the bottom plate. Because of the design as defined by the invention, high forces can be exerted on the bottom plate without having to fear any damage to its support. The required elements for interlocking the bottom plate with the connection element, for example journal pins, can be dimensioned small and designed with adequate mobility for producing the locking connection.

In a preferred embodiment, journal pins and projections acting as bearing cups are formed by molding on the inner surfaces of the plastic housing. The journal pins engage associated bearing bores of the bottom plate. The bottom plate is vertically supported on the bearing cups. Forces acting on the bottom plate are introduced into the plastic housing via the bearing cups. The journal pins are subject to little stress and therefore can be made small. Stops are usefully formed by molding on the inner surfaces of the plastic housing to limit the angle of swivel of the bottom plate. Such stops may consist of lugs that engage an oblong hole located on the circumference of the bottom plate.

According to an advantageous embodiment of the invention, the screw domes are arranged offset sideways in relation to the axis of swivel. The pressure springs acting on the plate carrying the bristles are supported on ring disks, which are secured on the screw domes. The bottom plate is swivel-connected with the plastic housing and movable versus the screw domes. The bottom plate may be screwed to the screw domes without any change in the design of the plastic housing in order to rigidly secure the bottom plate to the suction head in a very simple way. In one embodiment of the invention comprising a rigidly secured bottom plate, the pressure springs are clamped between the bottom plate and the plate carrying the bristles.

According to the invention, the plastic housing of the suction head is a standard component of the construction that can be used without change with suction heads having either a movable or a rigidly secured bottom plate. If the suction head is to be equipped with a rigidly secured bottom plate, only minor modifications are required on the bottom plate. Such modifications consist in designing the bottom plate with additional bores associated with the screw domes, so that screws can be screwed into the screw domes through the bores. Because the plastic housing and the bottom plate are joined with each other by means of a locking connection, assembling the suction head as defined by the invention is simple.

BRIEF DESCRIPTION OF THE DRAWINGS

The invention is explained in greater detail in the following description with the help of the drawings showing an exemplified embodiment of the invention, in which.

DETAILED DESCRIPTION OF PREFERRED EMBODIMENTS

Figure 1:
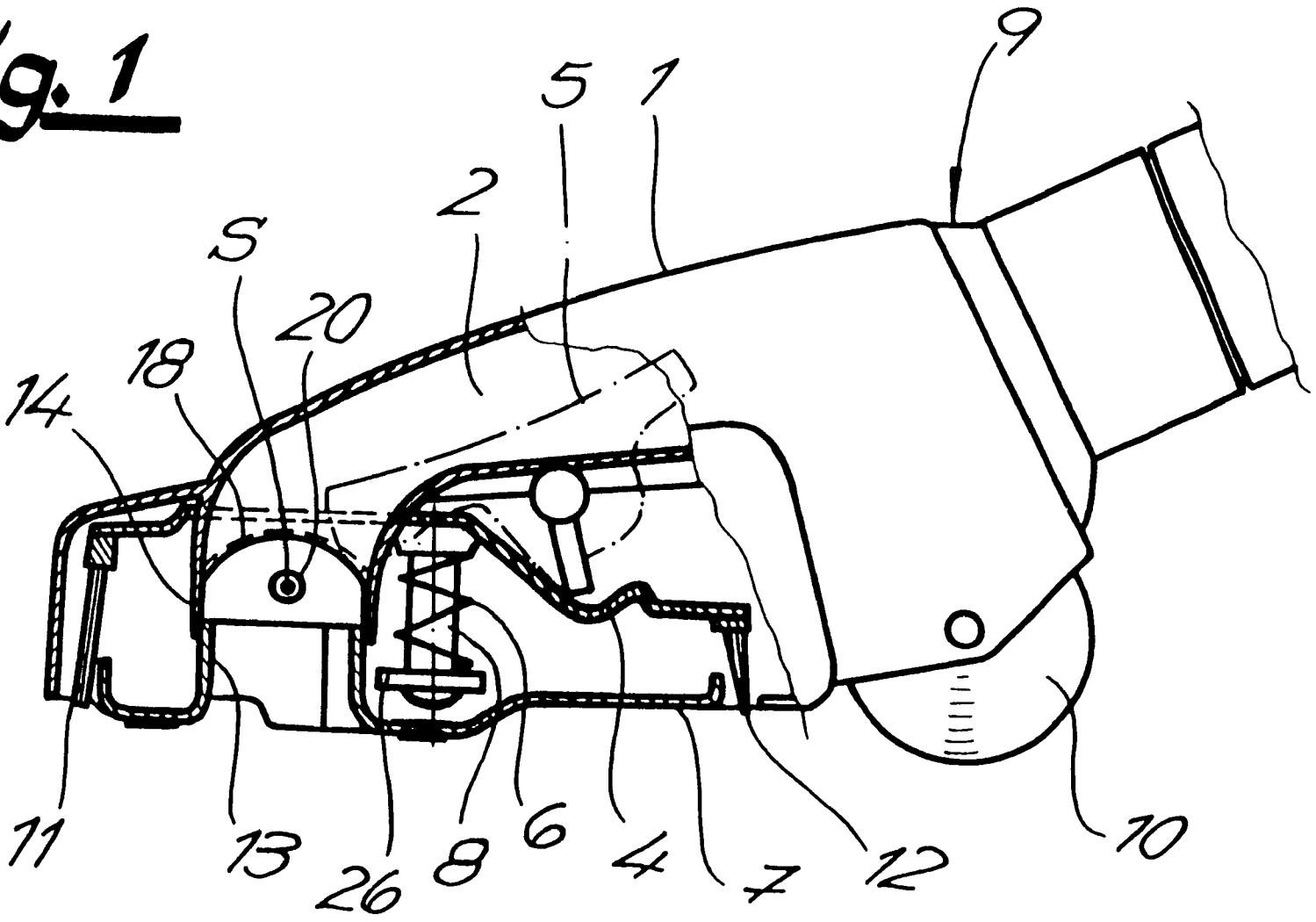
FIG. 1 shows a longitudinal section through a suction head as defined by the invention for floor vacuum cleaners.

The basic structure of the suction head is shown in FIG. 1. The suction head comprises a single-part plastic housing 1, which contains a suction channel 2 and has a top side opening 3 for a foot switch, a bristles carrier plate 4, which is arranged in the housing 1 with vertical mobility and can be lowered against the action of the pressure springs 6 by actuating a foot switch 5 inserted in opening 3, and a bottom plate 7 arranged on the underside of the housing. Plastic housing 1 has two vertically aligned, dimensionally stable screw domes 8 for guiding bristles carrier plate 4 and pressure springs 6. Furthermore, the suction head is designed, in a manner known per se, with a swiveling and tilting joint 9 and has a running roller 10 that is connected to the rearward end of plastic housing 1. In the exemplified embodiment, a bristles strip 11 as well as a rubber lip 12 are connected with bristles carrier plate 4. The strip of bristles and the rubber lip can be retracted and extended on the underside of plastic housing 1 by a lifting and, respectively, lowering movement of bristles carrier plate 4. Bottom plate 7 contains a suction mouth 13, which adjoins a vertically aligned, box-shaped connection element 14 of suction channel 2. Suction mouth 13 feeds into a bottom channel 15 of bottom plate 7. Bottom channel 15 substantially extends transversely in relation to the suction direction across the entire length of bottom plate 7.

Figure 2:
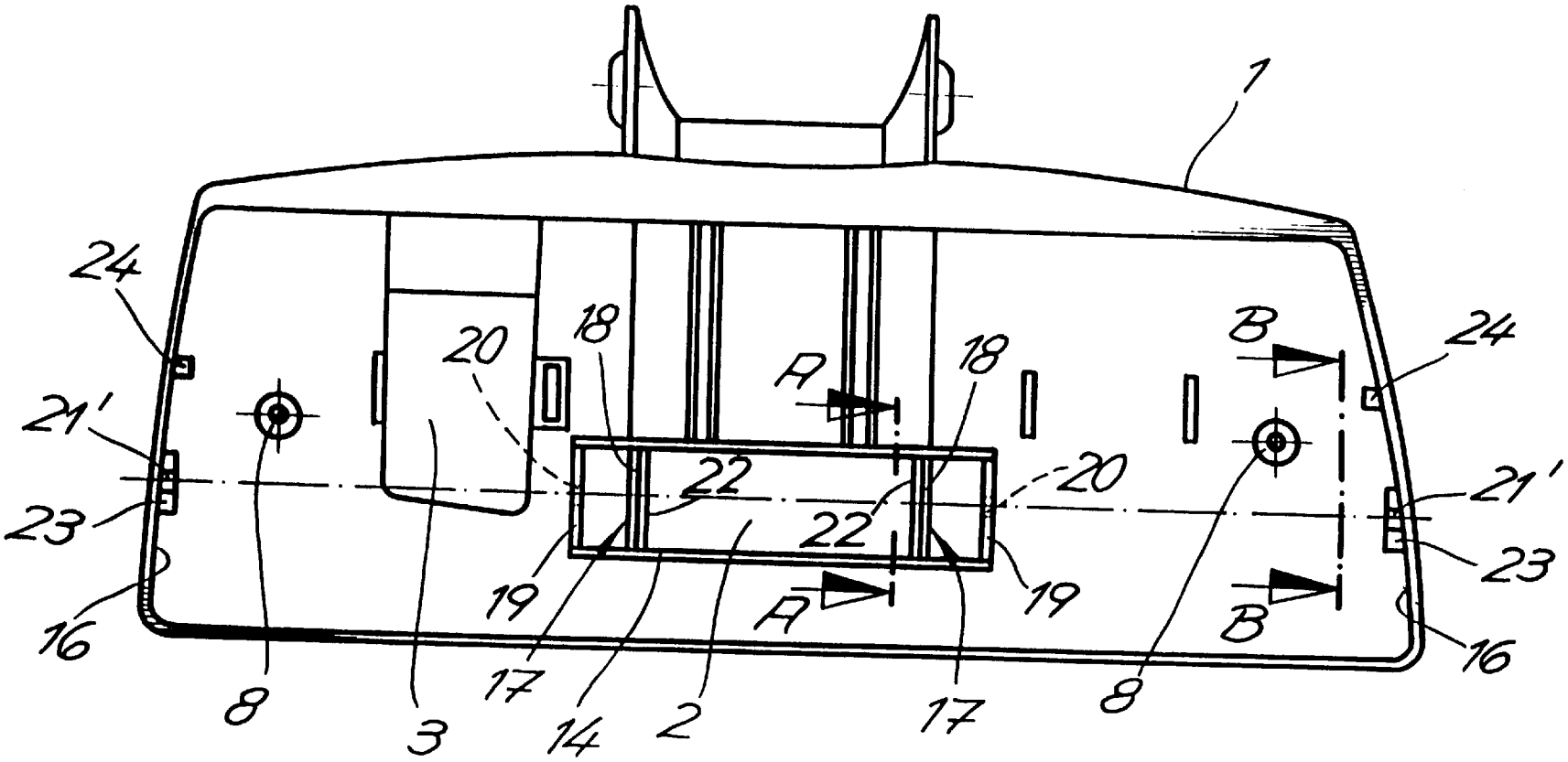
FIG. 2 shows a top view of the inner side of the plastic housing forming the top part of the suction head.
Figure 3:
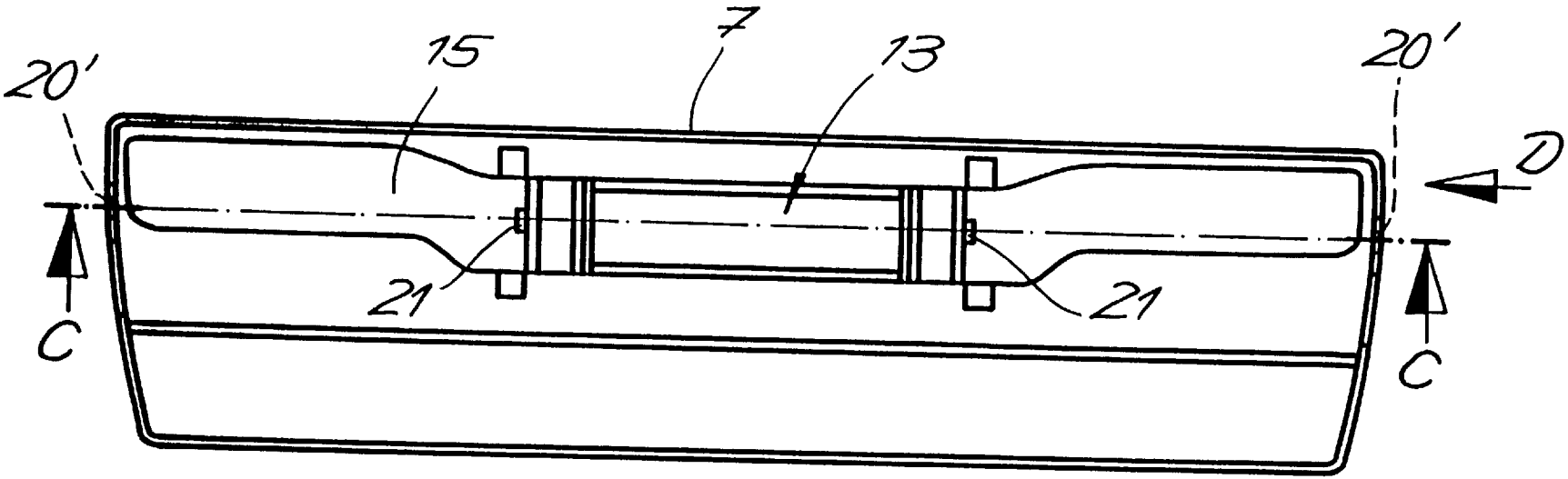
FIG. 3 is a top view showing the inner side of the bottom plate.
Figure 4:
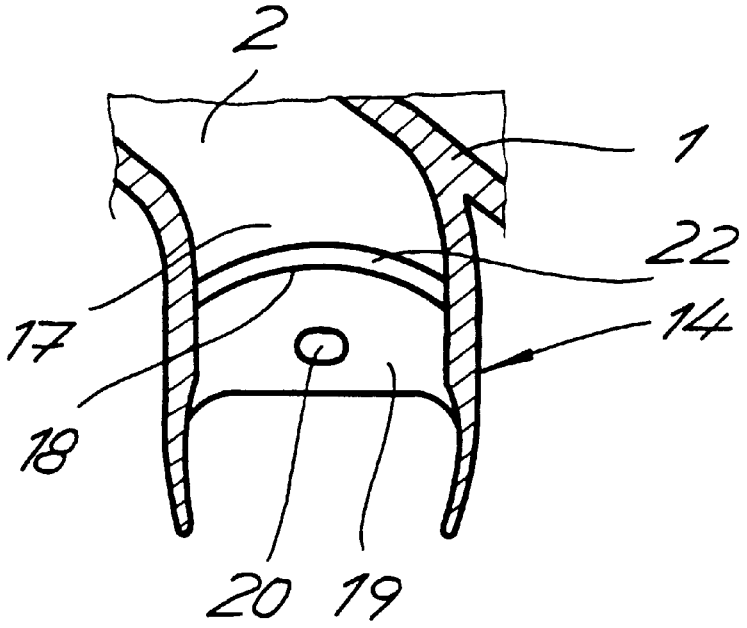
FIG. 4 shows the section A—A from FIG. 2.
Figure 6:
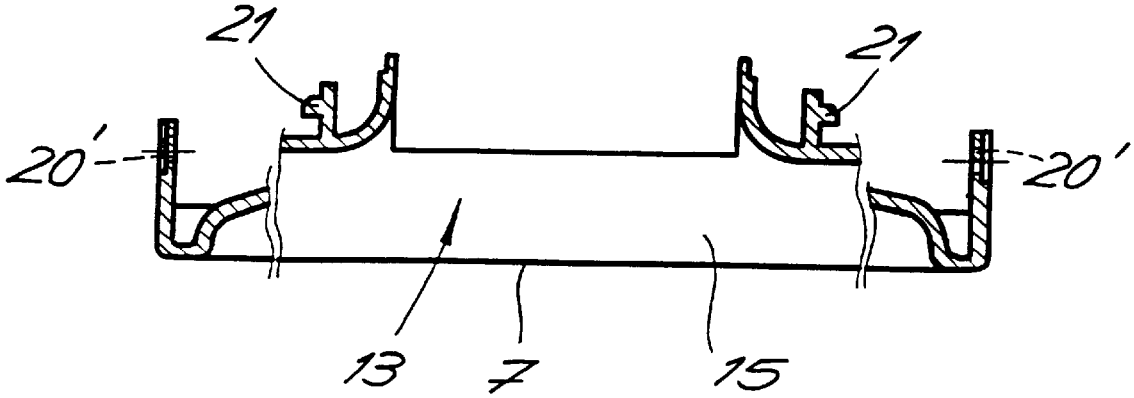
FIG. 6 shows the section C—C from FIG. 3.

Bottom plate 7 is pivot-mounted both on the connection element 14 of suction channel 2, and on the end side on the inner surfaces 16 of plastic housing 1. The support of bottom plate 7 on connection element 14 is explained in the following with the help of the drawings. FIG. 2 shows that box-shaped connection element 14 contains transverse bridges 17, which define suction channel 2 laterally. The lower edges of the transverse bridges are designed in the form of support surfaces 18, which are rounded in the form of curves. Bottom plate 7 is supported on the rounded, curved support surfaces 18 of connection element 14 (FIG. 4). Connection element 14 has wall surfaces 19 extending parallel to transverse bridges 17. Bottom plate 7 is interconnected with rotational mobility to wall surfaces 19 of connection element 14. For this purpose, wall surfaces 19 of the connection element contain the bores 20, which engage the lugs 21 formed by molding on bottom plate 7 (FIG. 6). The drawings show, furthermore, that curved, rounded support surfaces 18 have a lateral collar 22 for guiding bottom plate 7 axially.

Figure 5:
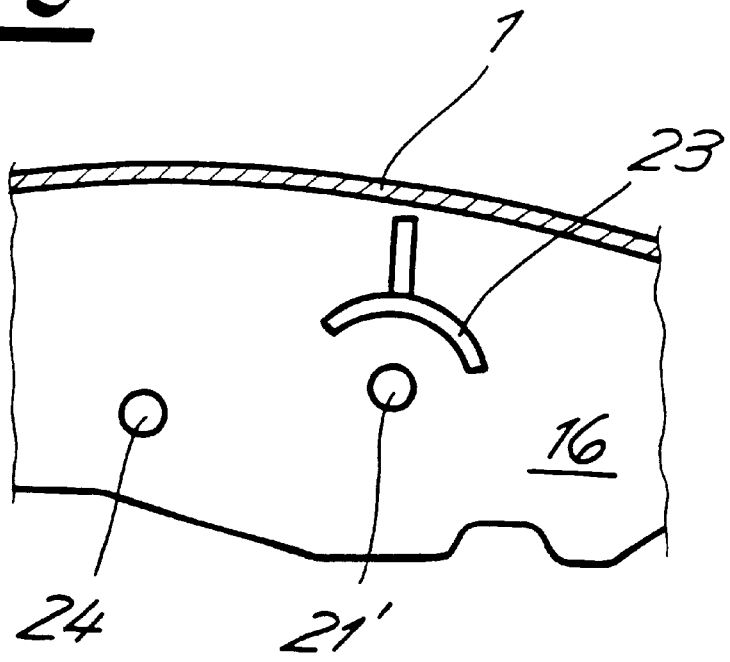
FIG. 5 shows the section B—B from FIG. 2.

The journal pins 21' and the projections 23, the projections being designed as bearing cups, are formed by molding on inner surfaces 16 of plastic housing 1 (FIG. 5). As a locking connection is being established, journal pins 21' engage associated bearing bores 20' of bottom plate 7, the bearing bores being shown in FIG. 7. Furthermore, bottom plate 7 is vertically supported on bearing cups 23 as can be seen by comparing, for example, FIG. 5 with FIG. 7.

Figure 7:
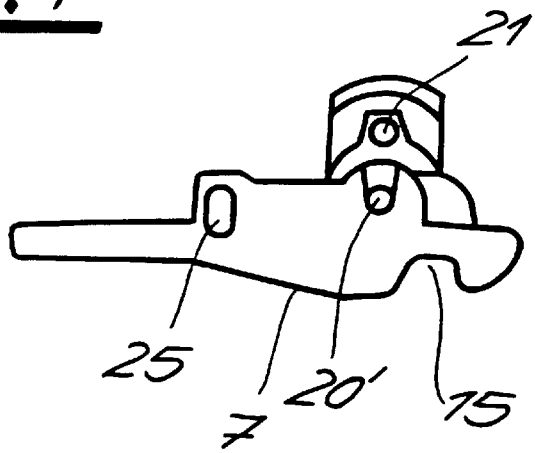
FIG. 7 is a side view of the bottom plate viewed from the direction D in FIG. 3.

Stops 24 are molded on inner surfaces 16 of plastic housing 1. The stop means limit the angle of swivel of bottom plate 7. In the exemplified embodiment, stops 24 consist of lugs that engage an oblong hole 25 that is arranged on the periphery of bottom plate 7 as shown in FIG. 7.

FIGS. 1 and 2 show that screw domes 8 are arranged offset sideways in relation to the swivel axis "S" of bottom plate 7. Pressure springs 6 are supported on ring disks 26, which are secured on screw domes 8.

Bottom plate 7 can be screwed also to screw domes 8 with no change in the design of plastic housing 1. In that way, bottom plate 7 can be rigidly connected with housing 1. To this extent, the suction head can be selectively equipped with a movable bottom plate or with a bottom plate that is rigidly joined with the plastic housing.

What is claimed is:

1. A suction head for a floor vacuum cleaner comprising:

(a) a unitary plastic housing comprising a suction channel, a top side opening, inner surfaces, and pressure springs arranged in the housing, said suction channel comprising a vertically aligned, rectangular-shaped connection element comprising transverse bridges defining the suction channel laterally, said bridges having lower edges having curved rounded support surfaces, and wall surfaces extending parallel to the transverse bridges;

(b) a vertically movable bristles carrier plate carrying bristles arranged in the housing;

(c) a foot switch inserted in the opening for lowering the bristles carrier plate against the action of the pressure springs;

(d) two vertically aligned, dimensionally stable screw domes arranged in the housing for guiding the bristles carrier plate and the pressure spring;

(e) a bottom plate pivotally mounted on the connection element and on the inner surfaces of the housing, said bottom plate being supported on the curved rounded support surfaces of the connection element and rotatably interconnected with the wall surfaces of the connection element, said bottom plate comprising a bottom channel and a suction mouth feeding into the bottom channel, said suction mouth arranged on the underside of the housing and adjoining the connection element.

2. The suction head according to claim 1, wherein the bottom plate comprises molded lugs and the wall surfaces of the connection element contain bores engaged by the lugs.

3. The suction head according to claim 1, wherein the curved, rounded support surfaces have a lateral collar for guiding the bottom plate along said support surfaces.

4. The suction head according to claim 1, wherein the bottom plate comprises bearing bores and the inner surfaces of the housing comprise molded journal pins and bearing cups, the journal pins engaging associated bearing bores of the bottom plate to form a locking connection, and the bearing cups vertically supporting the bottom plate.

5. The suction head according to claim 1, wherein the inner surfaces of the plastic housing comprise molded stops limiting the angle of swivel of the bottom plate.

6. The suction head according to claim 5, wherein the stops consist of lugs engaging an oblong hole on the periphery of the bottom plate.

7. The suction head according to claim 1, wherein the bottom plate has a swivel axis and the screw domes are offset sideways from the swivel axis.

8. The suction head according to claim 1, further comprising ring disks secured on the screw domes and supporting the pressure springs.

9. The suction head according to claim 1, wherein the bottom plate is screwed to the screw domes to rigidly join the bottom plate with the housing.

* * * * *